US005825130A

United States Patent [19]

Nerone et al.

[11] Patent Number: 5,825,130

[45] **Date of Patent: *Oct. 20, 1998**

[54] EXTERNAL METALLIZATION CONFIGURATION FOR AN ELECTRODELESS FLUORESCENT LAMP

[75] Inventors: Louis R. Nerone, Brecksville; James D. Mieskoski, Seven Hills, both of Ohio

[73] Assignee: General Electric Company, Schenectady, N.Y.

[ * ] Notice: The term of this patent shall not extend beyond the expiration date of Pat. No. 5,412,280.

[21] Appl. No.: 656,726

[22] Filed: Jun. 3, 1996

Related U.S. Application Data

[63] Continuation of Ser. No. 228,979, Apr. 18, 1994, abandoned.

[51] Int. Cl.[6] ..... H01J 65/00

[52] U.S. Cl. ..... 313/635; 313/313; 313/489; 315/85

[58] Field of Search ..... 313/489, 493, 313/635, 313, 573; 315/248, 39, 85

[56] References Cited

U.S. PATENT DOCUMENTS

| | | | |
|---|---|---|---|
| 3,814,973 | 6/1974 | Thouret et al. | 313/313 |
| 4,568,859 | 2/1986 | Houkes et al. . | |
| 4,675,577 | 6/1987 | Hanlet | 315/248 |
| 4,727,294 | 2/1988 | Houkes et al. | 315/248 |
| 4,728,867 | 3/1988 | Postma et al. | 313/493 |
| 4,940,923 | 7/1990 | Kroontje et al. . | |
| 5,239,238 | 8/1993 | Bergervoet et al. | 315/85 |
| 5,325,018 | 6/1994 | El-Hamamsy | 315/248 |
| 5,397,966 | 3/1995 | Vrionis et al. | 315/248 |
| 5,412,280 | 5/1995 | Scott et al. | 313/493 |

FOREIGN PATENT DOCUMENTS

| | | | |
|---|---|---|---|
| 53-137577 | 1/1978 | Japan | 315/248 |

*Primary Examiner*—Sandra L. O'Shea
*Assistant Examiner*—Matthew J. Esserman
*Attorney, Agent, or Firm*—George E. Hawranko

[57] ABSTRACT

An electrodeless fluorescent lamp having an emission suppression arrangement utilizing a capacitive filtering element formed by a first conductive layer disposed on a portion of the interior surface of the lamp envelope, a second conductive layer on a corresponding external portion of the lamp envelope and the glass material of the lamp envelope disposed therebetween, achieves significant emission reduction yet at the same time reduces eddy current losses otherwise occurring at the second conductive coating portion of the capacitive filtering element. A plurality of slots formed in the second conductive coating are effective so as to reduce the circular flow of eddy currents around the second conductive layer, such eddy currents as would otherwise adversely affect the Q of the circuit.

6 Claims, 2 Drawing Sheets

EXTERNAL METALLIZATION CONFIGURATION FOR AN ELECTRODELESS FLUORESCENT LAMP

This is a continuation of application Ser. No. 08/228,979, filed on Apr. 18, 1998, now abandoned.

FIELD OF THE INVENTION

This invention relates to an external metallization configuration for an electrodeless discharge lamp. More particularly, this invention relates to such a metallization arrangement as can be used on an electrodeless fluorescent lamp for the purpose of reducing electromagnetic interference (EMI) yet at the same time, reduce the effects of eddy currents on the performance of the components necessary for driving the discharge within the lamp.

BACKGROUND OF THE INVENTION

Compact fluorescent lamps and particularly, electrodeless discharge fluorescent lamps are considered to be key elements in efforts to reduce energy demand stemming from the use of lighting products. Specifically, electrodeless discharge lamps offer significant energy efficiency advantages over a conventional incandescent lamp and further offer life expectance advantages even over the popular compact fluorescent lamps. Moreover, such an electrodeless fluorescent lamp is expected to provide additional energy efficiency gains in that the profile of the electrodeless fluorescent lamp as compared to a conventional compact fluorescent lamp is significantly more consistent with that of conventional incandescent lamps and as such, will fit into more sockets than will a compact fluorescent lamp.

An example of an electrodeless fluorescent lamp can be found in U.S. Pat. No. 4,010,400 in which the basic principles of such lamp are described. This patent discusses that an ionizable medium can be contained in a lamp envelope and excited to a discharge state by the introduction of an RF signal in close proximity to the lamp envelope, which lamp envelope contains the appropriate phosphor coatings to allow the discharge energy to be converted to visible light. This patent further discusses that an electric field generated by the RF signal initiates the discharge whereas a magnetic field then sustains continuous operation of such discharge thereafter. In order to generate this RF signal the electrodeless discharge lamp contains a ballast circuit arrangement disposed in the base of the lamp and which circuit includes a coil member extending into a cavity formed in the lamp envelope, the coil member being effective for outputting the RF signal. In order for the electrodeless discharge lamp to reach widespread commercial acceptance, it will be necessary to achieve this ballast circuit arrangement in a reliable and cost effective manner using as few a number of components as possible. Additionally, it will be necessary in the generation of the RF signal, electromagnetic interference (EMI), which can have both conducted and radiated components, is kept below a level which is in compliance with Government regulatory standards. For instance, Section 18.307(c) of Chapter 47 of the US Code of Federal Regulations requires that for RF lighting products operating between 1.6 and 30 MHz and being sold into commercial and industrial channels of trade, the conducted emissions level not exceed 3000 microvolts which can also be expressed as 70 dB(microvolts). For such products sold into consumer channels of trade, the emissions level is even lower. Additionally, the International Electro-Technical Commission Standard dealing with Electromagnetic compatibility of lamps (CISPR 15) requires that the conducted component of EMI in the frequency range of between 0.5 and 5.0 megahertz, be less than 56 dB(microvolts).

A number of proposals for the suppression of Electromagnetic Interference (EMI) have been made to alleviate this problem. One such proposal is to provide a capacitive arrangement by means of a conductive layer disposed on the inside of the lamp envelope and a conductive layer disposed on the outside of the lamp, such capacitive arrangement being coupled during lamp operation to the supply mains. Such a proposal is set forth in U.S. Pat. No. 4,727,294. U.S. Pat. Nos. 4,568,859 and 4,940,923 also disclose emission suppression techniques. While such proposals are somewhat effective, there is an inherent disadvantage to the use of the metallized conductor placed on the outside of the lamp envelope to form one of the capacitive plates, that is, there are significant eddy currents associated with such a conductive layer and such eddy currents are detrimental to the starting properties of the lamp operating circuit. Specifically, the high eddy currents cause a lowering of the output voltage of the excitation coil which in some cases, results in an insufficient starting voltage so that the fill does not initially break down.

Another proposal for the suppression of EMI emissions has been to connect one end of a parasitic coil to the exciter coil, that is, the coil member which outputs the RF signal. The other end of the parasitic coil would be allowed to float to a voltage equal and opposite to that developed across the exciter coil. This results in electric field cancellation which can significantly reduce the conducted component of RFI. Such an arrangement can be found in U.S. Pat. No. 4,710,678. Though effective in reducing EMI, this approach also suffers in that, by adding an additional relatively expensive component, the parasitic coil, the overall cost of the discharge lamp has again been increased by a measurable amount.

Accordingly, it would be advantageous to provide a ballast circuit arrangement for an electrodeless discharge lamp which has minimal numbers and cost of components and satisfies the regulatory requirements relating to EMI suppression, yet does not result in high eddy currents which can adversely affect the starting characteristics of the lamp operating circuit.

SUMMARY OF THE INVENTION

Accordingly, it is an object of this invention to provide an electrodeless low pressure discharge lamp which includes an EMI suppression arrangement that is implemented in a cost effective manner and which does not result in the generation of eddy current losses that could otherwise adversely affect the starting characteristics of the lamp operating circuit.

In accordance with the principles of the present invention, there is provided an electrodeless low pressure discharge lamp which includes a lamp envelope containing a fill energized to a discharge state upon coupling of an RF signal thereto. A fluorescent coating is applied to the interior surface of the lamp envelope to allow for the conversion of the discharge energy to visible light. The lamp envelope is mounted on a housing member which has a threaded screw base mounted thereon to enable connection of line power to a ballast circuit arrangement disposed within the housing. In producing the RF signal which is inductively coupled to the discharge by means of an excitation coil, electromagnetic interference (EMI) is also generated; which EMI must be suppressed to comply with governmental regulations. A capacitive filter member is disposed on a portion of the lamp envelope for the purpose of suppressing such EMI. The capacitive filter member includes a first plate portion formed by a layer of conductive material disposed on a portion of the interior surface of the lamp envelope, a second plate portion disposed on the corresponding portion of the exterior surface of the lamp envelope opposite to the first plate portion, with the glass material of the lamp envelope disposed therebetween. The second plate portion has a plurality of slots formed therein which are effective so as to reduce eddy current losses occurring at the second plate portion.

In the preferred embodiment of the invention, the plurality of slots formed in the second plate portion are very thin slices cut into the metallized material of the second plate portion and which are disposed in a manner substantially parallel to one another and which collectively, do not substantially change the capacitive value of the capacitive filter member.

BRIEF DESCRIPTION OF THE DRAWINGS

In the following detailed description, reference will be made to the attached drawings in which.

DETAILED DESCRIPTION OF THE INVENTION

Figure 1:
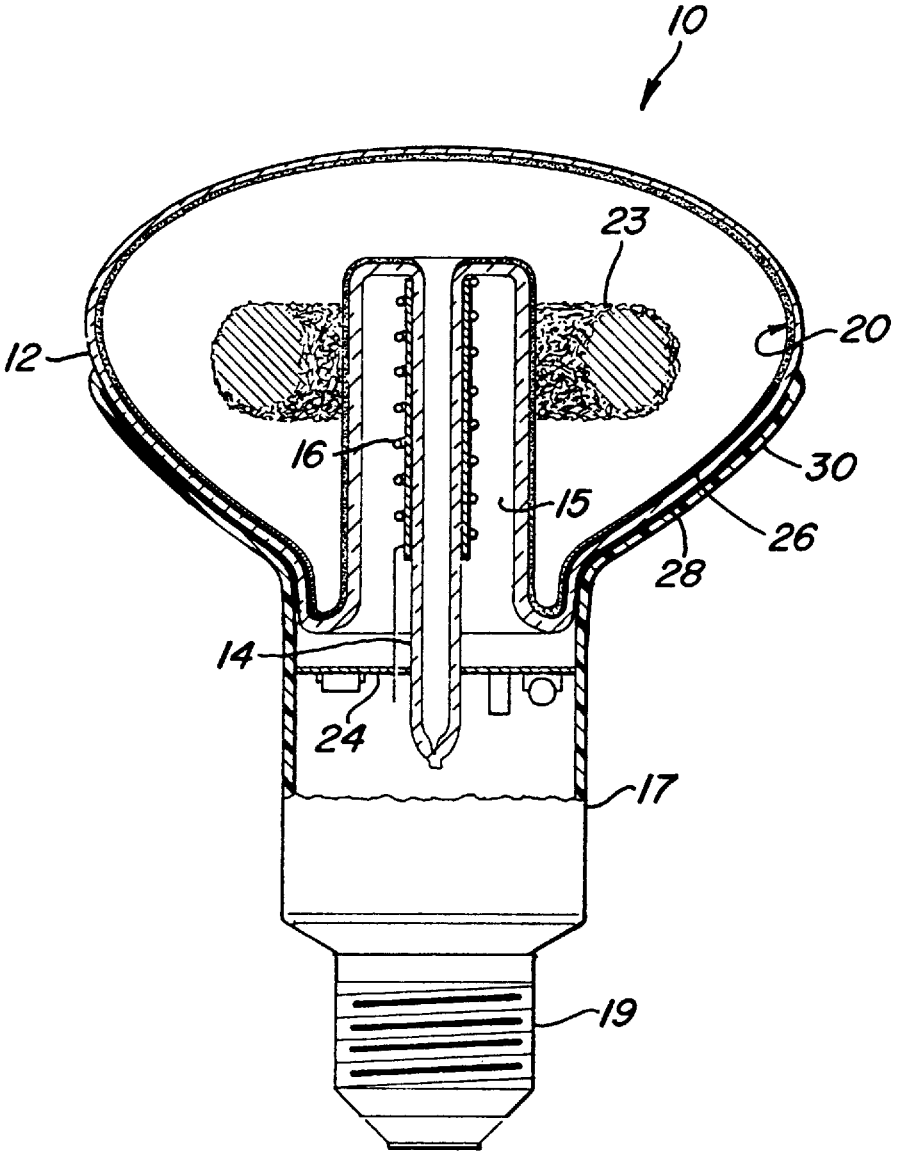
FIG. 1 is an elevational view in section of an electrodeless low pressure discharge lamp constructed in accordance with the present invention.

As seen in FIG. 1, a low pressure electrodeless fluorescent lamp 10 includes a lamp envelope 12 having a lower portion which fits within a housing base assembly 17. A conventional threaded screw base 19 is mounted on the housing base assembly 17 for connecting line power to a ballast circuit arrangement 24 disposed within housing base arrangement 17. The ballast circuit arrangement 24 includes an RF coil 16 which extends within a re-entrant cavity 15 of the lamp envelope 12. The RF coil includes a core and a winding which are disposed around the exhaust tube 14 extending down from the top of the re-entrant cavity 15 and into the region of the base housing assembly 17 in which the ballast circuit arrangement 24 is disposed. When energized, the ballast circuit arrangement 24 is effective for generating an RF signal which is inductively coupled to a fill contained within lamp envelope 12 so as to produce discharge 23. Discharge 23 is effective in a conventional manner for converting energy into visible light in cooperation with the phosphor coating 20 disposed on the interior wall surface of lamp envelope 12.

In addition to the phosphor coating 20, also disposed on the lower portion of the interior surface of lamp envelope 12 is a layer of a conductive material 26 which is applied to the lamp envelope before application of the phosphor material. As will be described hereinafter in further detail, this conductive material forms one plate portion of a capacitive filter member effective for the suppression of EMI which occurs during the operation of the coupling of the RF signal to the discharge. In one embodiment of the invention, the interior conductive layer is provided by means of application of a fluorinated tin oxide coating (FTO); such coating being fired onto the glass surface to insure durability of such coating over the expected life of the lamp 10.

Additionally, as shown in FIG. 1, the electrodeless low pressure discharge lamp 10 can be provided in the form of a reflector type of lamp which would add the further requirement of providing a reflective coating such as a finely divided titania onto the lower portion of the lamp envelope 12 as well as the surface area of the re-entrant cavity 15 in order to insure the appropriate direction of light output through a face region located at the top portion of the lamp envelope 12. Of course, it can be appreciated that the emission suppression arrangement of the present invention would work equally as well with other shapes of lamp envelopes for instance a conventional A-line configuration found on a typical incandescent lamp, and is also suitable for use with high pressure discharge lamps.

Disposed on a portion of the external surface of lamp envelope 12 opposite to the interior layer of conductive material 26 is a second metallized conductive layer 28. The second layer of conductive material, in cooperation with the interior layer of conductive material 26 and the glass material of the lamp envelope 12 disposed therebetween form a capacitor wherein the interior layer of conductive material and the second conductive layer form the plates of the capacitor and the glass material of the lamp envelope 12 forms the dielectric material. The second conductive layer can be provided by use of a frit arrangement. Specifically, in the preferred embodiment, a silver layer is painted onto the lamp envelope 12 and then fired so that the second conductive layer 28 formed thereby is essentially fused into the glass so as to result in a long-lasting, durable configuration. This capacitive element can be electrically coupled to the screw base 19 or can be coupled to other shielding elements (not shown) disposed within housing base 17. Such connection is effective so as to prevent against a charge building up on the exterior surface of the lamp and to further insure that conducted emission limits are minimized by use of the filtering characteristics of such capacitive element. Of course, other conductive materials could be utilized for the second conductive layer 28 as well and could also be applied in a more conventional manner as, for instance, by means of an adhesive cement. As further seen in FIG. 1, an outer protective cover 30 is disposed over the second conductive layer 28. The protective cover most preferably would be formed of the same material as the housing 17 and in fact could be formed either by a separate piece or by extending the upper lip portion of the housing 17.

Figure 2:
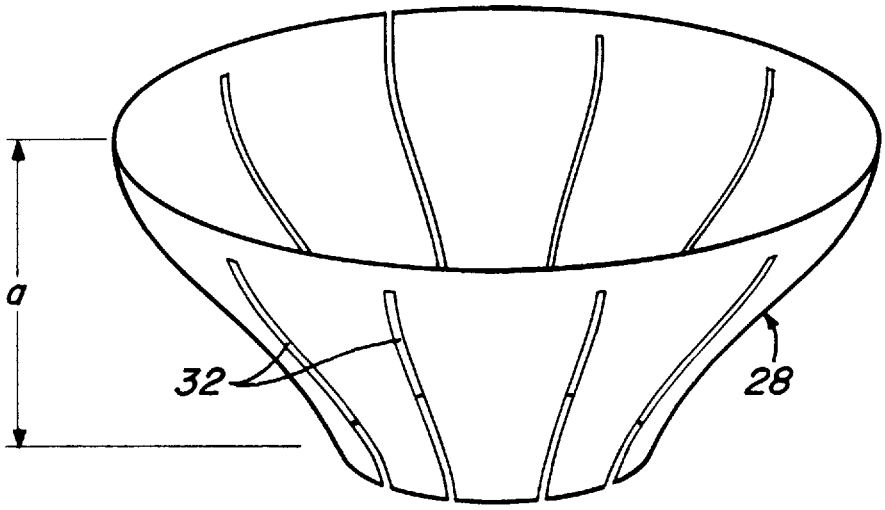
FIG. 2 is an elevational view of the second plate portion of the capacitive filter member constructed in accordance with the present invention.

As seen in FIG. 2, the second conductive layer 28 is formed in a manner to substantially conform to the contour of the bottom portion of the lamp envelope 12. Of course, it would be possible to modify the shape of the second conductive layer 28 in the event that a different shape lamp envelope were utilized, such modification being contemplated as within the scope of the present invention.

Previous efforts to provide an emission suppression arrangement using a conductive outer layer as shown in previously referenced U.S. Pat. No. 4,727,294, have suggested the use of a solid conductive layer on the exterior surface of the lamp envelope. It has been found that such an arrangement results in the generation of eddy current losses which in turn results in the reduction of the Q-factor associated with the resonant circuit used to provide the RF signal coupled to the discharge. It is known that the Q-factor is measured as the ratio of the inductance of the resonant circuit to the resistance of such resonant circuit. The effect of this reduction in the Q-factor is that a lower output voltage is present at the excitation coil of the RF circuit. This lower output voltage reduces the starting capability of the ballast circuit arrangement 24 and in some cases, is such that the RF coil voltage cannot reach sufficient amplitude to break down the mixture of mercury and krypton which comprise the fill contained within lamp envelope 12.

As shown in FIG. 2, there are a plurality of slots 32 formed on the second conductive layer 28, such slots 32 extending completely through the thickness of the second conductive layer 28. These slots are disposed in an equidistant manner relative to each other along the periphery of the second conductive layer 28. It can also be seen that the slots extend for a length substantially equal to the width of the metallization that makes up the second conductive layer 28, such width as is indicated by reference "a" of FIG. 2. In fact, the plurality of slots extend to the bottom edge of the second conductive layer 28 so as to result in an open section at the bottom of each of the slots 32. In a preferred embodiment, at least one of the slots extends from the bottom edge to the top edge so as to prevent a closed loop conduction path from occurring through the second conductive layer 28. Additionally, the width of the respective slots 32 is substantially smaller than the space of the intermediate conductive layer 28 portions disposed therebetween. Specifically, the spaces between the slots 32 are at least ten times larger in dimension than the width of the slots.

The second conductive layer 28 is annularly shaped and tapered at one end to conform to the shape of lamp envelope 12. It can be seen that the plurality of slots are disposed at approximately right angles to the cross-sectional area of second conductive layer 28, although the slots could be at other angles. As shown, the slots are extremely thin in width and are substantially smaller in size than the width of the metallization material that spans between any two consecutive slots 32. The use of the plurality of slots 32 in the second conductive layer 28 can reduce the circular flow of eddy currents, thus reducing the loss attributable to the second conductive layer 28 and thereby reducing the detrimental effect on the circuit Q. Moreover, by constructing the second conductive layer 28 such that the plurality of slots 32 are extremely thin in relation to the span of conductive material between successive slots, the surface area of the second conductive layer 28 is not significantly reduced so as to reduce the capacitive value of the capacitor arrangement formed by the interior conductive layer, the second conductive layer and the glass material disposed therebetween. As such, the benefits of EMI suppression are not sacrificed by the reduction of the eddy current losses associated with the use of the plurality of slots 32 formed in the second conductive layer.

Although the above-described embodiment constitutes the preferred embodiment of the invention, it should be understood that modifications can be made thereto without departing from the scope of the invention as set forth in the appended claims. For instance, it would be possible to vary the shape and placement of the plurality of slots 32 and yet achieve the reduction in the eddy current losses that are achieved by such arrangement. Also, while the ballast is shown as being at least partially contained in the housing, the capacitive arrangement of this invention is equally applicable to lamps in which the ballast is located elsewhere.

We claim:

1. An electrodeless discharge lamp comprising:

a lamp envelope having a fill contained therein, said fill being operable so as to produce a discharge upon coupling of an RF signal thereto;

a member on which said lamp envelope is mounted;

a ballast circuit arrangement receptive of line power and effective so as to produce said RF signal therefrom;

a capacitive filter member disposed on a portion of said lamp envelope and being electrically coupled to said ballast circuit arrangement so as to suppress electromagnetic interference generated upon coupling said RF signal to said discharge;

wherein said capacitive filter member includes a first plate portion formed by a layer of conductive material disposed on a portion of the interior surface of said lamp envelope, a second plate portion disposed on the outside surface of said lamp envelope opposite to said first plate portion, and said lamp envelope disposed between said first and second plate portions;

wherein said second plate portion extends over a portion of said lamp envelope that does not exceed one half of the surface area of said lamp envelope and has a plurality of slots formed therein over portions of said envelope which are effective to reduce eddy current losses occurring at said second plate portion; and, wherein at least one of said plurality of slots extends across said second plate portion to prevent a closed loop conduction path for eddy currents to occur in said second plate portion.

2. An electrodeless discharge lamp as set forth in claim 1 wherein said first plate portion is a fluorinated tin oxide layer fired onto said portion of the interior surface of said lamp envelope.

3. An electrodeless discharge lamp as set forth in claim 1 wherein said second plate portion is annularly formed having at least one circumferential dimension associated therewith, and further wherein said plurality of slots are formed in said second plate portion at approximately right angles relative to such at least one circumferential dimension.

4. An electrodeless discharge lamp as set forth in claim 1 wherein spaces disposed between each of said plurality of slots in said second plate portion are at least ten times larger in dimension than the width of a slot.

5. An electrodeless discharge lamp as set forth in claim 3 wherein said plurality of slots extend to the end of one open end associated with said second plate portion.

6. An electrodeless discharge lamp as set forth in claim 1 wherein said first and second plate portions are electrically connected together only capacitively.

* * * * *